US007318394B2

(12) United States Patent
Stevens et al.

(10) Patent No.: US 7,318,394 B2
(45) Date of Patent: Jan. 15, 2008

(54) MOUNT FOR CONNECTING AUTOMOTIVE FAN MOTOR TO HOUSING

(75) Inventors: William M. Stevens, Maynard, MA (US); William Murray Black, Ann Arbor, MI (US); Stephens Nicholls, Bühl (DE); Markus Liedel, Pegnitz (DE); Thomas Helming, Baden-Baden (DE); Peter Bruder, Ottersweier (DE); Hugo Hermann, Lauf (DE); Britt Weigand, Bühl (DE); Klaus Weickenmeier, Ettlingen (DE); Jens Ulrich, Baden-Baden (DE)

(73) Assignee: Robert Bosch LLC, Broadview, IL (US)

( * ) Notice: Subject to any disclaimer, the term of this patent is extended or adjusted under 35 U.S.C. 154(b) by 121 days.

(21) Appl. No.: 10/877,768

(22) Filed: Jun. 25, 2004

(65) Prior Publication Data

US 2004/0255878 A1 Dec. 23, 2004

(51) Int. Cl.
*F01P 7/10* (2006.01)

(52) U.S. Cl. ..... 123/41.49; 417/360

(58) Field of Classification Search ..... 123/41.49, 123/41.46, 41.48, 41.56, 195 A; 165/121, 165/76; 417/360, 423.15, 424.1, 242.2
See application file for complete search history.

(56) References Cited

U.S. PATENT DOCUMENTS 3,499,388 A 3/1970 Eberhardt
4,210,833 A * 7/1980 Neveux ..... 310/58

(Continued)

FOREIGN PATENT DOCUMENTS

EP 0 219 021 10/1986

(Continued)

*Primary Examiner*—Hai Huynh
(74) *Attorney, Agent, or Firm*—Fish & Richardson P.C.

(57) ABSTRACT

The motor of an automotive cooling fan system is attached to a housing by either bayonet mount, screw mount, or axial-snap features on both motor and housing, as well as a cradle structure on the housing.

28 Claims, 11 Drawing Sheets

U.S. PATENT DOCUMENTS

| | | | | | |
|---|---|---|---|---|---|
| 4,538,967 | A | * | 9/1985 | Furukawa | 417/360 |
| 4,548,548 | A | * | 10/1985 | Gray, III | 416/189 |
| 4,625,134 | A | | 11/1986 | Weaver | 310/83 |
| 4,685,513 | A | | 8/1987 | Longhouse et al. | |
| 4,849,667 | A | | 7/1989 | Morrill | 310/91 |
| 4,979,584 | A | | 12/1990 | Charles | |
| 5,056,412 | A | | 10/1991 | Gautier et al. | 92/368 |
| 5,117,656 | A | | 6/1992 | Keck et al. | |
| 5,133,617 | A | | 7/1992 | Sokn et al. | 403/349 |
| 5,341,871 | A | | 8/1994 | Stelzer | |
| 5,342,167 | A | * | 8/1994 | Rosseau | 415/119 |
| 5,443,363 | A | * | 8/1995 | Cho | 415/211.1 |
| 5,489,186 | A | * | 2/1996 | Yapp et al. | 415/58.7 |
| 5,522,457 | A | | 6/1996 | Lenz | |
| 5,573,383 | A | | 11/1996 | Uemura et al. | |
| 5,716,200 | A | * | 2/1998 | Mirumachi et al. | 417/360 |
| 5,775,076 | A | | 7/1998 | Mossman | 56/119 |
| 5,871,335 | A | | 2/1999 | Bartlett | 416/244 |
| 5,996,685 | A | * | 12/1999 | Alizadeh | 165/121 |
| 6,027,307 | A | * | 2/2000 | Cho et al. | 415/173.5 |
| 6,045,327 | A | * | 4/2000 | Amr | 415/211.2 |
| 6,045,340 | A | * | 4/2000 | Batchelder et al. | 417/360 |
| 6,106,228 | A | | 8/2000 | Bartlett | |
| 6,155,335 | A | | 12/2000 | Acre et al. | |
| 6,262,504 | B1 | * | 7/2001 | Bartlett | 310/89 |
| 6,332,760 | B1 | * | 12/2001 | Chung | 417/411 |
| 6,360,815 | B1 | * | 3/2002 | Vadrot et al. | 165/121 |
| 6,793,469 | B2 | * | 9/2004 | Chung | 417/411 |
| 7,078,835 | B2 | * | 7/2006 | Gross et al. | 310/89 |
| 2002/0070009 | A1 | * | 6/2002 | Vadrot et al. | 165/121 |
| 2003/0133811 | A1 | * | 7/2003 | Yen | 417/360 |

FOREIGN PATENT DOCUMENTS

| | | |
|---|---|---|
| FR | 2 699 961 | 12/1993 |

* cited by examiner

MOUNT FOR CONNECTING AUTOMOTIVE FAN MOTOR TO HOUSING

CROSS-REFERENCE TO RELATED APPLICATION

This application claims the benefit of the filing date of U.S. Application Ser. No. 60/162,376, filed Oct. 29, 1999, which is hereby incorporated by reference.

BACKGROUND OF THE INVENTION

This invention concerns attaching drive motors to engine cooling fan systems.

Such systems include a fan attached to a motor which is in turn attached to the motor mount of a fan housing which holds it in place and positions the motor/fan assembly to operate with a heat exchanger. The attachment of the motor to the motor mounting structure is subject to a number of considerations. For servicing, the attachment should be capable of easy assembly and disassembly, e.g. with hand tools. It must also undergo many hours of exposure to vibration and temperature cycling without developing looseness or rattling between the motor and motor mounting structure. Additionally, the attachment should function despite manufacturing variances inherent in mass-produced parts.

Many existing attachment systems use metal fasteners such as screws, studs, nuts, and rivets in order to satisfy these requirements. These fasteners add cost to the product and increase part count. In a market where demands on quality are increasing, they may also introduce additional failure modes, some of which are difficult to detect. Measures typically are taken to insure that parts are not shipped with fasteners which are missing, incorrectly selected, or incorrectly tightened. Finally, these fasteners must be supplied with replacement parts, to insure the integrity of repairs.

SUMMARY OF THE INVENTION

We have discovered a motor mount assembly—particularly for vehicular engine-cooling fan motors—which allows a motor to be mounted into and retained by a motor mounting structure without additional fasteners which can withstand the rigorous requirements to which vehicular motor mounting systems are subjected.

One aspect of the invention features an assembly in which the motor includes multiple connector elements (such as tabs), which are integral with the motor. The motor mount is integral with at least a portion of the fan housing, and the mount includes multiple recesses which are sized and shaped to receive and engage the connector elements of the motor by combined axial and rotational movement of the motor relative to the motor mount. In some cases, the connector elements are radially-extending tabs, and the motor-mounting recesses of the housing are sized, shaped and positioned to receive the tabs as a bayonet mount. Alternatively, the connector elements of the motor may include screw threads which cooperate with the motor-mounting recesses to form a screw mount.

Preferably, the motor-mount also includes radially elastic supports which cradle the motor so as to exert a radial force on the motor. The motor is rotatable and axially moveable relative to the radially elastic supports, for ease of assembly. Another feature of the invention may include multiple rigid elements (e.g. rigid ribs) positioned to limit the radial travel of the motor. The rigid elements (or at least one of them) may be different from or integral with the radially elastic supports. In one embodiment where they are integral with the radially elastic supports, the radially elastic support includes, at least in part, surfaces which extend in a generally circumferential direction from a rigid rib and contact the external surface of the motor at a position slightly inward of the innermost rib portion, forming an interference fit.

The fan housing generally includes members (e.g. stators or arms) which extend generally radially inward and support the motor-mount. Often the housing includes a structure which surrounds the fan, controls air recirculation, and supports the radially extending members that in turn support the motor mounts. It is also common for the housing to include an air guide structure to guide the airflow between a heat exchanger and the fan. Typically, the motor mount and/or the radial mount supports, and/or the structure extending around the fan and/or the air-guide structure are injection-molded plastic, most typically as a single part.

The connector elements of the motor are typically metal. The connector elements may be integral with the motor flux ring, the motor case, or end-cover.

The connectors (e.g., tabs) may be of different dimensions with the motor mount recesses sized and shaped to key the orientation of the motor as it is inserted into the motor mount. Another way to orient the motor is to use tabs and motor-mount recesses which are spaced unevenly around the circumference of the motor.

One or more resilient latches on the motor mount can prevent the motor from rotating after it is rotated into position. Preferably, the connector elements and the motor mount recesses are shaped to permit insertion by rotation in the direction of torque that the operating fan exerts on the motor.

The motor mount recesses may be sized and shaped to permit the motor to slide into the motor mount as the motor is mounted from the front (i.e. the fan side of the motor mount). In this case, the motor-mount structure may include a heat or splash shield. Alternatively, the motor mount recesses may be sized and shaped to permit the motor to be mounted from the rear. In this case, the motor mount will generally include an opening through which the front of the motor will project when the motor is in position.

The invention also features methods of assembling the above described motor/fan assembly by sliding the motor axially into the mount and twisting it to secure the integral motor connectors in the motor mount.

Another aspect of the invention features an assembly in which the motor-mount comprises at least one resilient latch which deflects upon axial insertion of the motor and, after insertion, moves to a position in which the latch limits motor travel. The motor includes at least one feature which cooperates with the latch. In effect, a spring lock serves to lock the motor in position.

Many of the preferred features described above may also be used on this second aspect of the invention: a) radially elastic supports which cradle the motor and exert a radial force on the motor, the motor being axially moveable relative to the elastic supports; b) multiple rigid elements (e.g. ribs) positioned to limit the radial travel of the motor, the rigid members in some cases being integral with the radially elastic supports; c) the use of a single injection molded plastic part for the various parts of the housing (motor mount, generally radial supports for the mount, a fan-surrounding shroud and/or air guide structure).

Preferably, the motor feature that cooperates with the latch may be a) the edge of, or a tab integral with, the motor's flux ring; b) the edge of, or one or more tabs formed integrally with, the motor case; c) (where the motor includes an end cover which wraps around the edge of the motor case) the edge of the end cover; d) one or more tabs formed integrally with a motor end cover; and/or e) one or more holes in the motor case. These motor feature(s) may be configured to prevent rotation of the motor case. If the motor is mounted from the front, the motor-mounting structure may include a splash and heat shield. When the motor is mounted from the rear, the front portion of the motor may extend through an opening in the motor-mount structure.

To assemble the above-described second embodiment, the motor is inserted into the motor-mounting structure until it contacts axial stops. At this point, an axial latch has engaged a feature on the motor, completing the axial retention.

The bayonet mount, screw mount or the axially snapping arrangement provides ease of assembly. Cradling features may be needed to provide rigidity, durability, and robustness that satisfy manufacturing tolerances. For example, the flexible regions of these cradling features are sized to have an interference fit with the motor body over a range of manufacturing tolerances. They serve to maintain a tight fit between the motor and motor mounting structure over the range of dimensional variance inherent in production of both. Their flexibility also allows insertion of the motor with limited force, allowing manual assembly and disassembly for service. The stiff regions of these cradling features are sized to allow a small clearance between the motor and motor mounting structure over the range of dimensional variance. While they do not maintain a tight contact with the motor, they serve to limit movement of the motor within the motor mounting structure when the assembly is exposed to shock and vibration. This in turn limits strain on, and erosion of, the flexible regions of the cradling and the recesses in the motor mount described above.

The above-mentioned elasticity can alternately be accomplished through flexibility in the mounting structure rather than flexibility in specific cradling features.

The inner surfaces of the cradling features may need to have draft for easy injection molding. The motor mounting structure can be designed so that the cradling features rotate during insertion of the motor, so that the contacting surfaces become substantially parallel with the external contour of the motor. This rotation occurs circumferential twisting of pliable portions (e.g., the profile) of the motor mounting structure.

The features described above can be inverted, especially where the motor is fitted with molded plastic components. In this case, latches and flexible and rigid guiding features can be located on the motor assembly, wheras tabs, holes and other features to cooperate with said latches and guiding surfaces can be located on the motor mounting structure.

DESCRIPTION OF THE PREFERRED EMBODIMENTS

Figure 1:
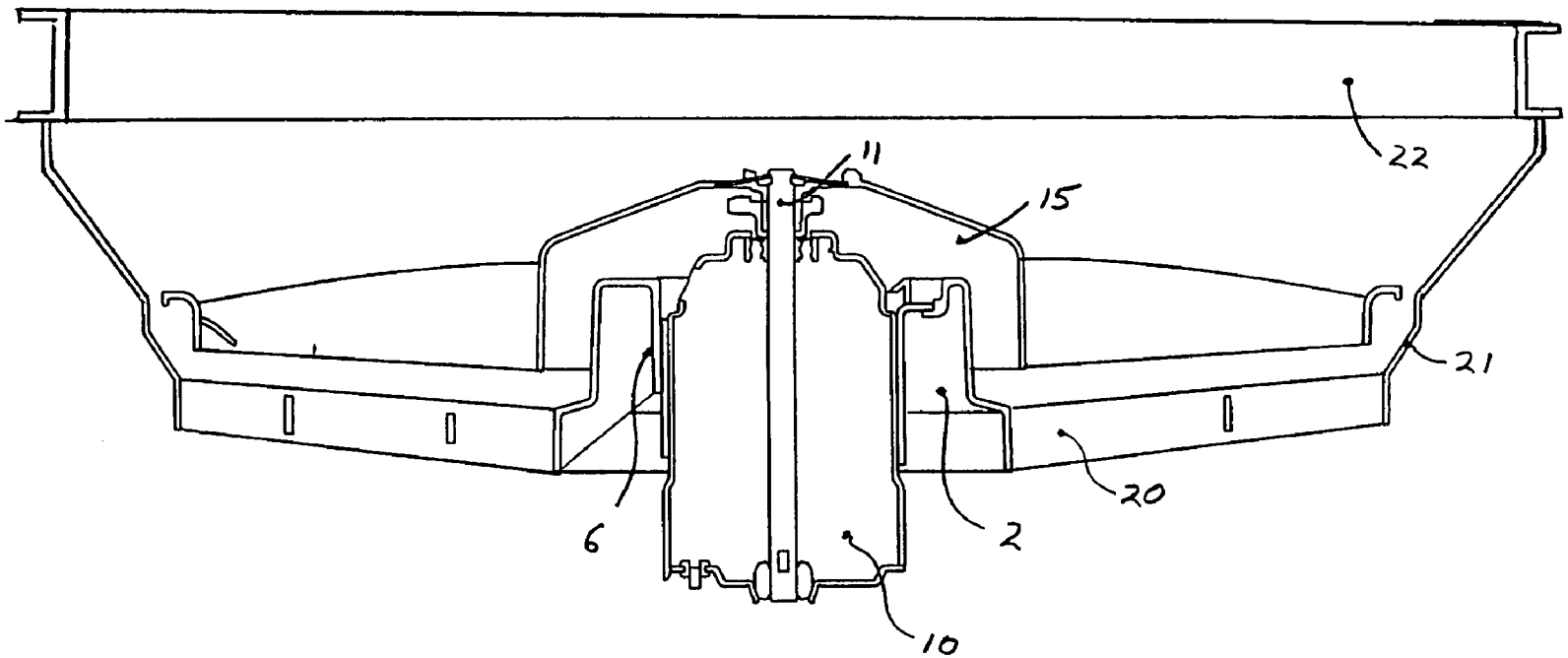
FIG. 1 is a partial cross-sectional, elevational view of an assembled cooling fan, drive motor, and fan housing

In FIG. 1 cooling fan drive motor 10 has a shaft 11 driving a cooling fan 15. The fan drive motor 10 is mounted within a motor mounting structure 2 which is connected by way of stators or arms 20 to a housing 21. The housing serves to position the fan/motor assembly with respect to a heat exchanger 22, as well as to conduct air between the heat exchanger and the fan.

Figure 2:
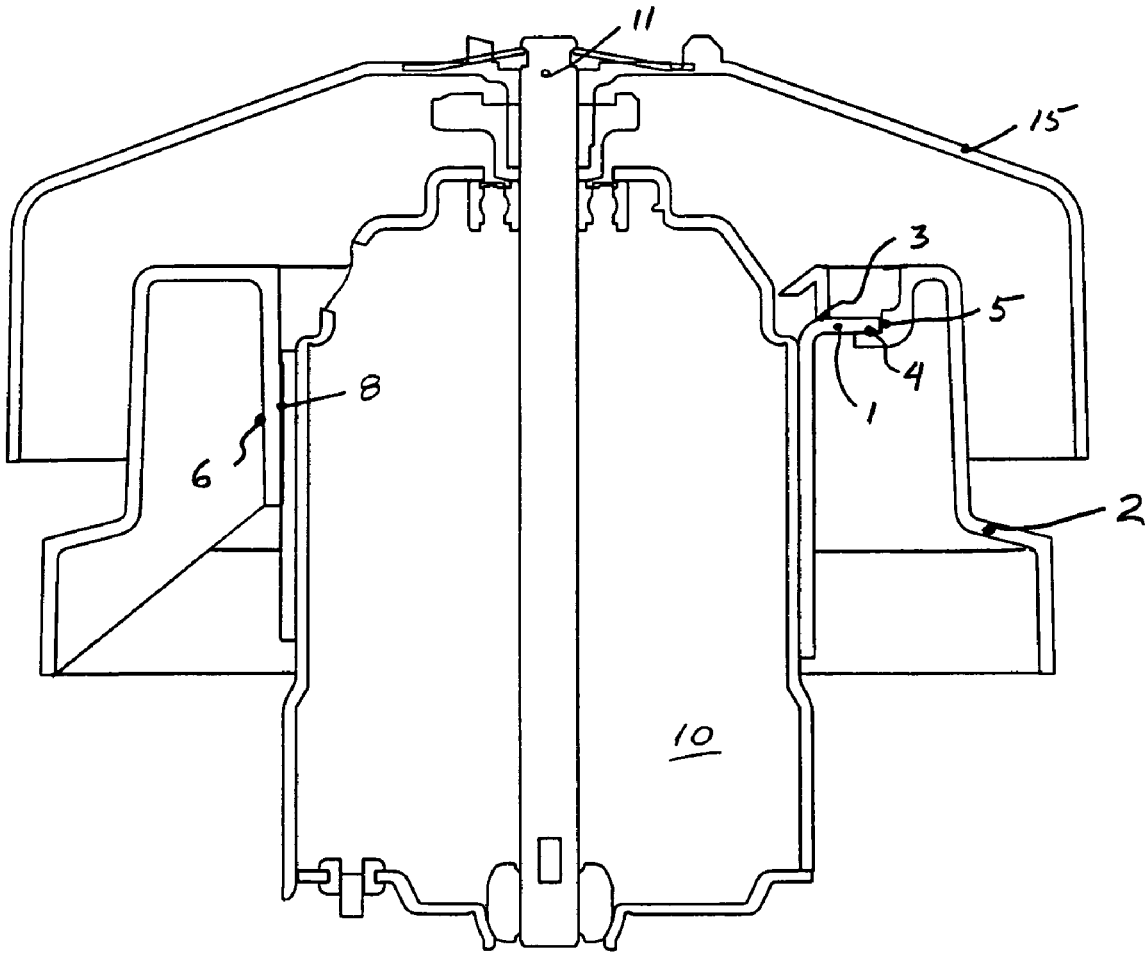
FIG. 2 is a section of the fan hub, drive motor, and motor mount.

In FIG. 2 motor mounting structure 2 and motor 10 are shown in more detail. One or more connector elements (or tabs) 1 extend radially from the motor case. These tabs can also be seen in pre-assembled position, in FIG. 3. The tabs can be formed from one of the components of the motor case. For example, they are part of the motor's flux ring in FIGS. 1-3.

FIG. 2 shows how tabs 1 are captured in recesses containing both forward axial surfaces 3 and rearward axial surfaces 4. Radial surfaces 5 center the motor within the mounting ring.

Figure 3:
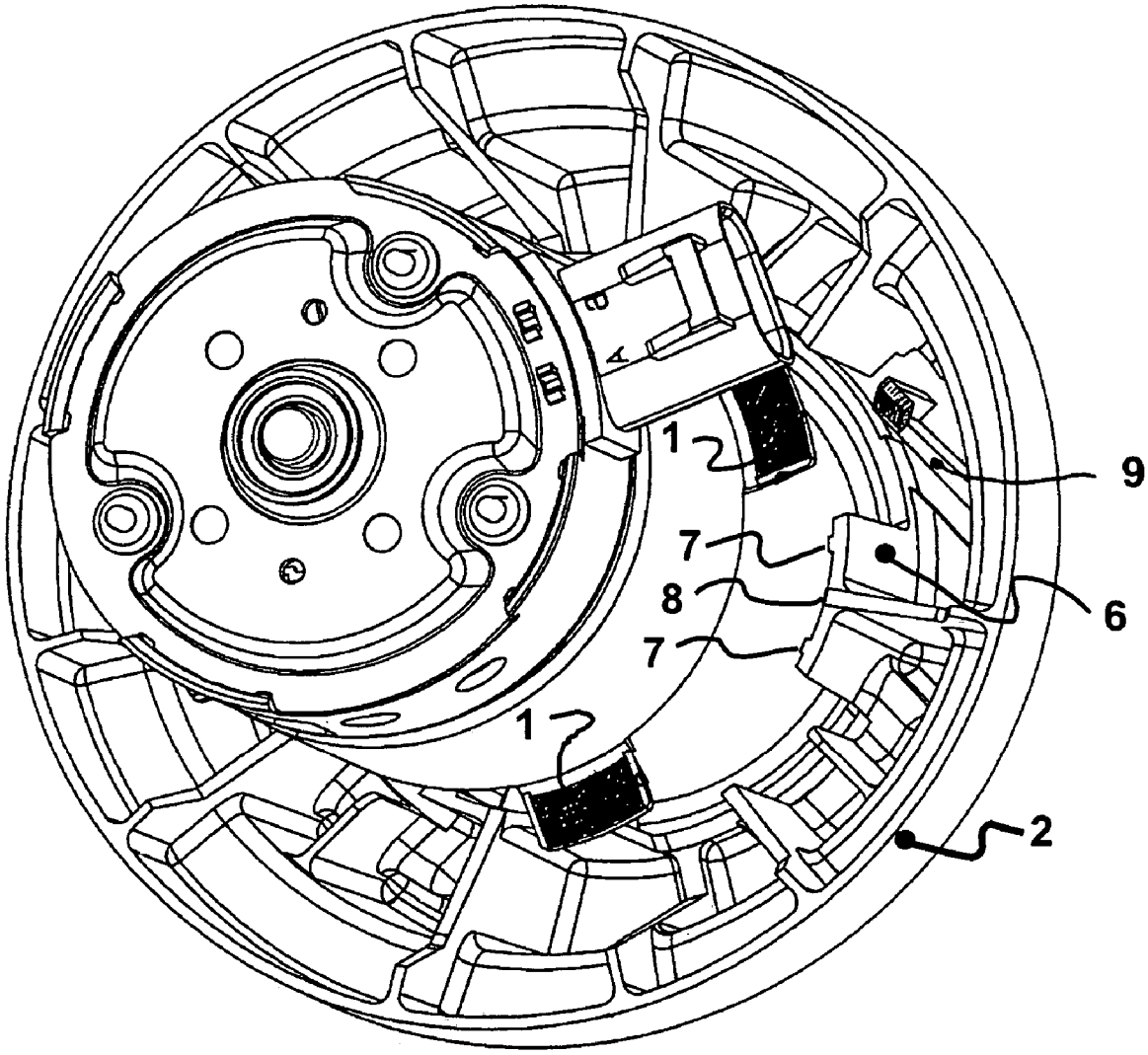
FIG. 3 is a perspective view of the motor and motor mount.
Figure 4:
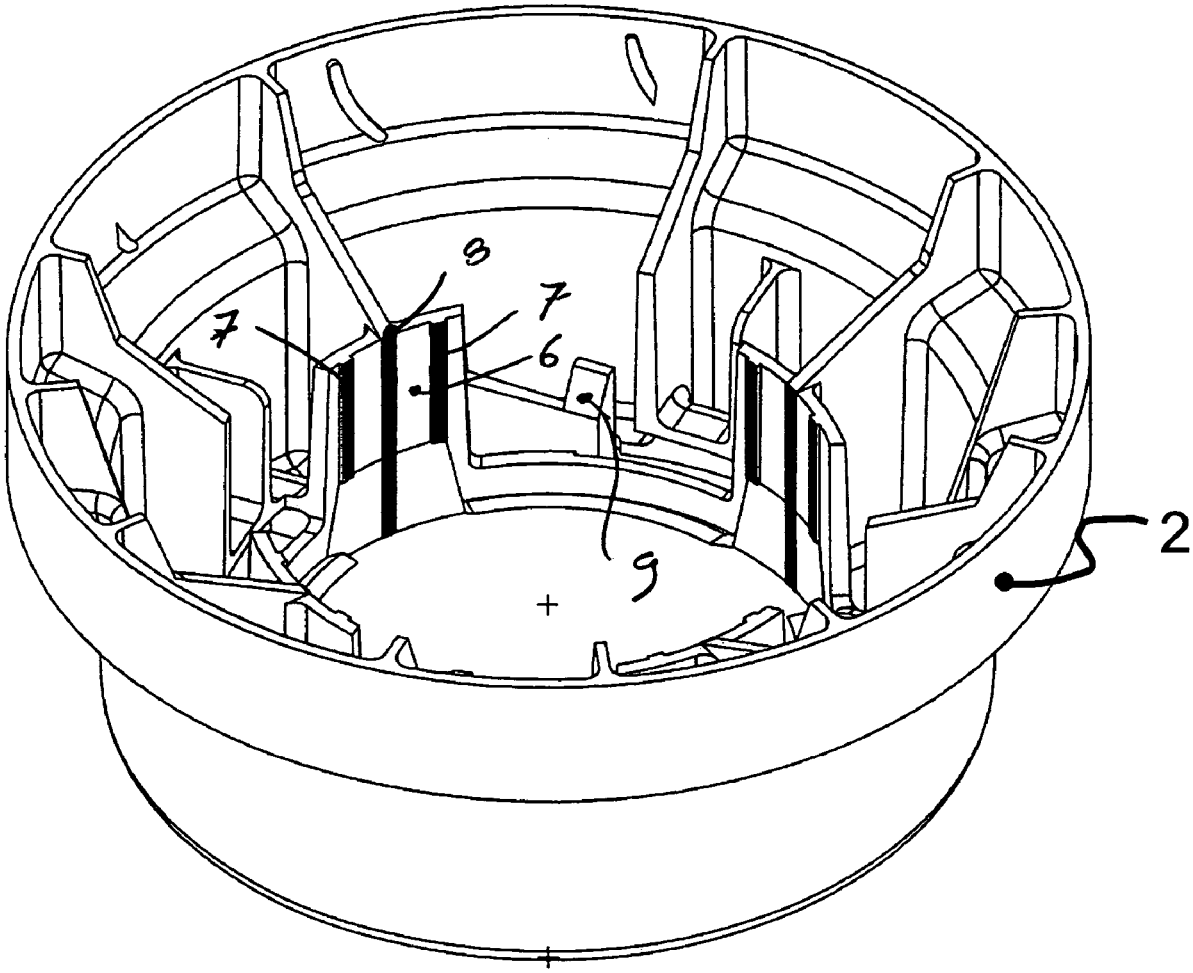
FIG. 4 is a perspective view of the motor mount with motor removed.

FIG. 4 identifies the components of resilient structures 6 which cradle the cylindrical surface of the motor. These cradling structures have regions 7 which are flexible with respect to the motor mounting structure 2. There are also regions 8 which are rigid with respect to the motor mounting structure 2. These cradling features 6,7,8 can be seen in FIGS. 2 and 3 as well.

In FIG. 4, the flexible regions 7 are manufactured so that they are at a radius from axis which is smaller than the outside radius of the motor in the areas where the two parts mate. These regions must then bend outward when the motor is inserted in the motor mounting structure. This interference fit persists throughout the range of manufacturing tolerances of both the plastic motor mounting structure and the mating areas on the motor.

The rigid regions 8 are manufactured so that they are at a radius from axis which is larger than the outside radius of the motor in the mating areas. This creates a clearance fit which persists throughout most or all of the range of allowable manufacturing tolerances for both the motor and cradling feature regions.

A circumferential latch 9 can be seen in FIGS. 3 and 4. This latch engages the tabs 1 after they are rotated against the stops in the recesses described above. This latch deflects in the radial direction. Alternative latch designs could deflect in the axial direction.

Figure 5:
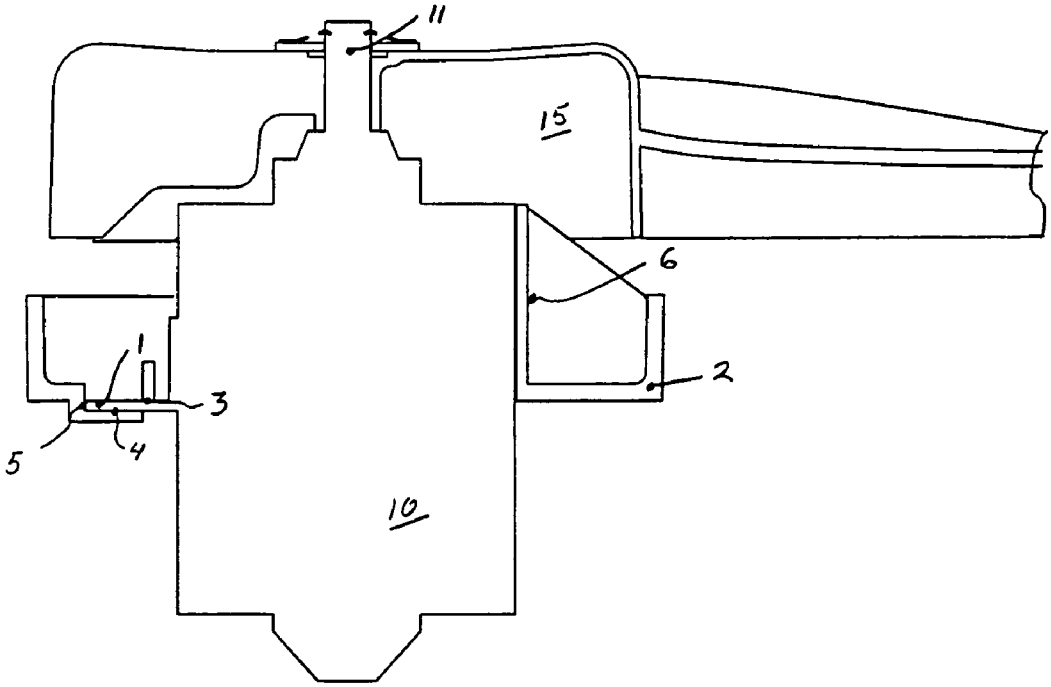
FIG. 5 is a partial cross-sectional, elevational view of the fan, drive motor, and motor mount showing radially elastic supports extending forward of the bayonet features.

Another preferred embodiment is shown in FIG. 5, where the cradling features 6 extend in the opposite axial direction than in FIGS. 1-4. The axial and radial retaining surfaces on the motor mounting structure, 3,4,5, may be formed differently due to considerations necessary to the molding of the motor mounting structure. However, the elements described of the configurations shown in FIGS. 1-4 generally apply to the configuration in FIG. 5, and the elements described in the above two embodiments can be adapted to a number of design variables such as the insertion direction of the motor, the relative axial positions of the cradling feature and the twist-lock features, and the axial direction in which the cradling features extend from the structure of the motor mounting structure.

Figure 6:
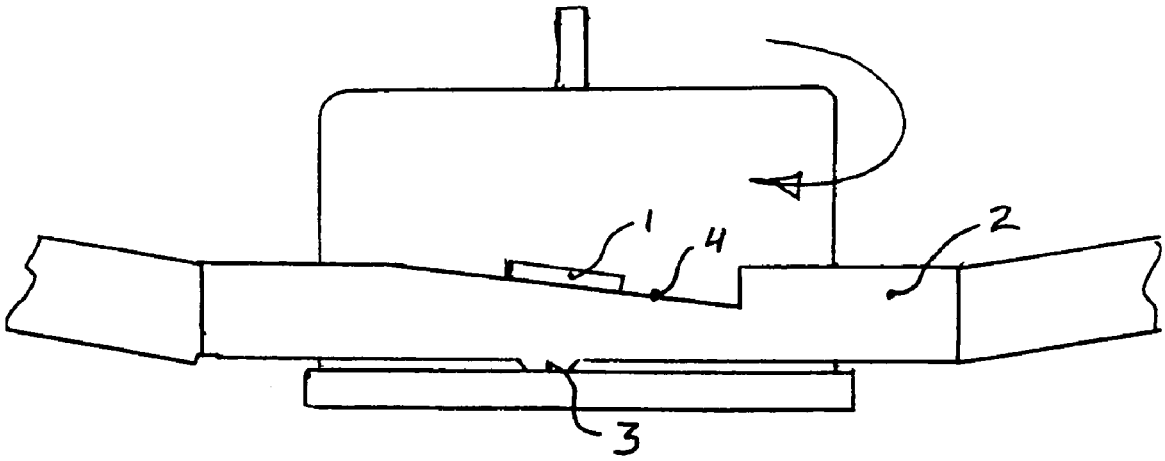
FIG. 6 is a partial elevational view showing a screw-mount interface between connector elements and motor mounting structure.

In FIG. 6, tabs 1 are inclined. They mate with inclined surfaces 4 in the recesses on the motor mount to form a screw mount. This allows for an assembly which is both rigid and tight in the axial direction.

Figure 7:
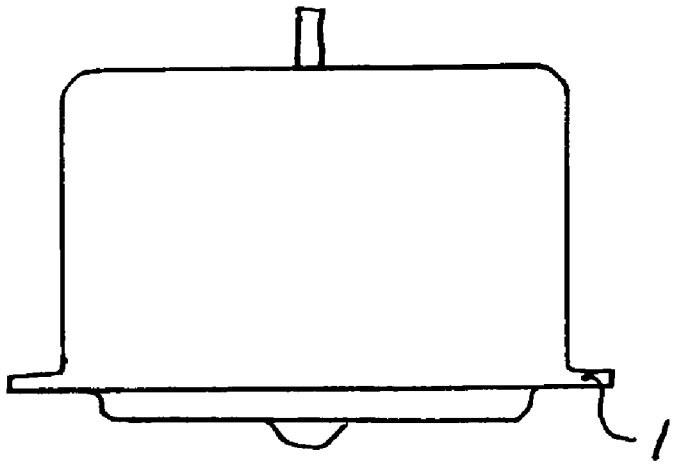
FIG. 7 is an elevational view of a motor with connector elements integral with the motor casing, and positioned at the rear of the motor.
Figure 8:
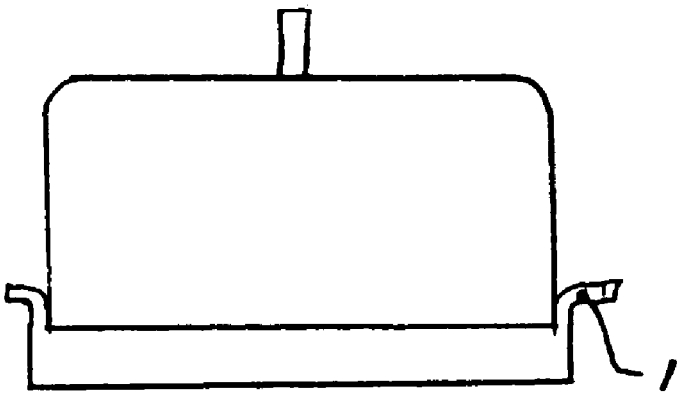
FIG. 8 is an elevational view of a motor with connector elements integral with end cover, and positioned at the rear of the motor.
Figure 9:
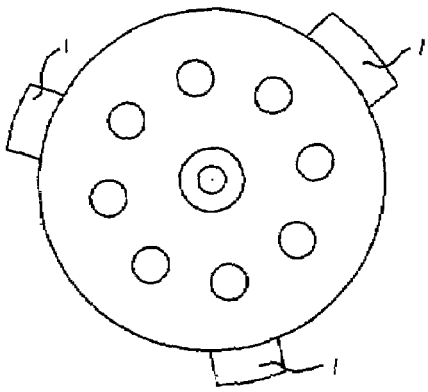
FIG. 9 is a frontal view of a motor with connector elements of varying sizes and shapes.
Figure 10:
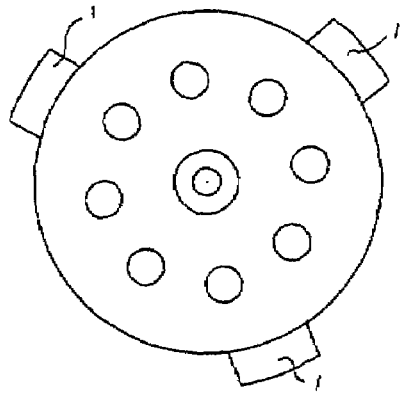
FIG. 10 is a frontal view of a motor with connector elements spaced unevenly around the circumference of the motor.

In FIG. 7 radial tabs 1 on the motor are formed as part of the main housing of the motor. In FIG. 8, tabs are formed from the end cover. Both schemes can be contrasted with FIG. 2, where tabs are formed from the motor flux ring.

Figure 11:
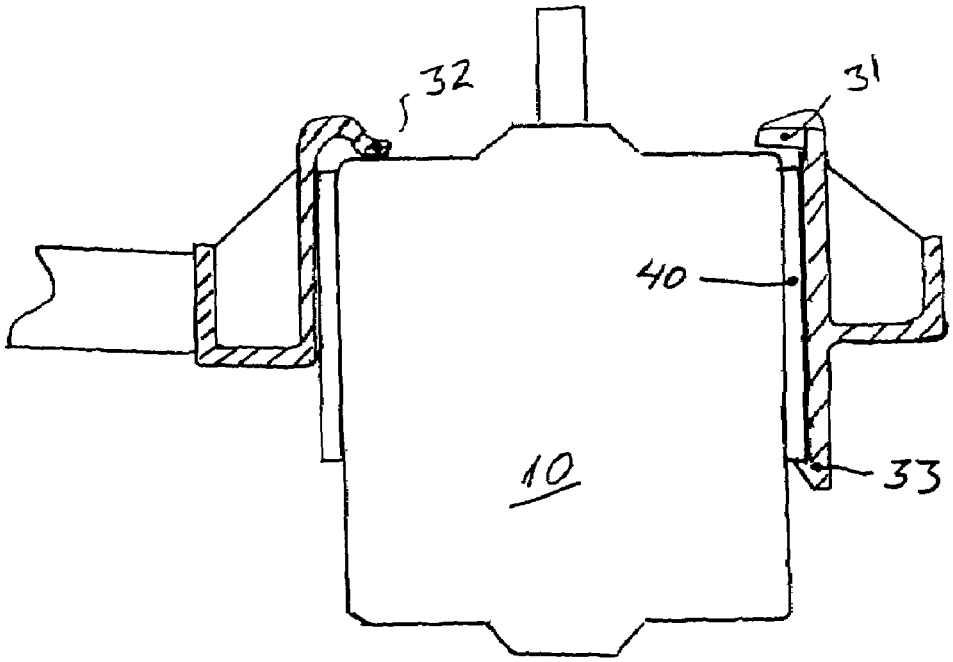
FIGS. 11, 12, 13 and 14 are partial cross-sectional, elevational views of a motor and motor mount showing axial snap-fit features.

In FIG. 11, the locking recesses are replaced by axial retention elements 31, 32 and latches 33. In this case, the latches engage the flux ring 40 of motor 10, rather than radial tabs. Some axial retention elements 32 are elastic, so that they maintain a tight fit over the range of manufacturing variation. Others 31 are a rigid. These are designed to have a clearance fit. The rigid elements 31 are added to the design if the elastic element 32 would not provide enough strength and durability. This depends mainly on the weight of the motor as compared to the desired insertion force to engage the latch 33.

Figure 12:
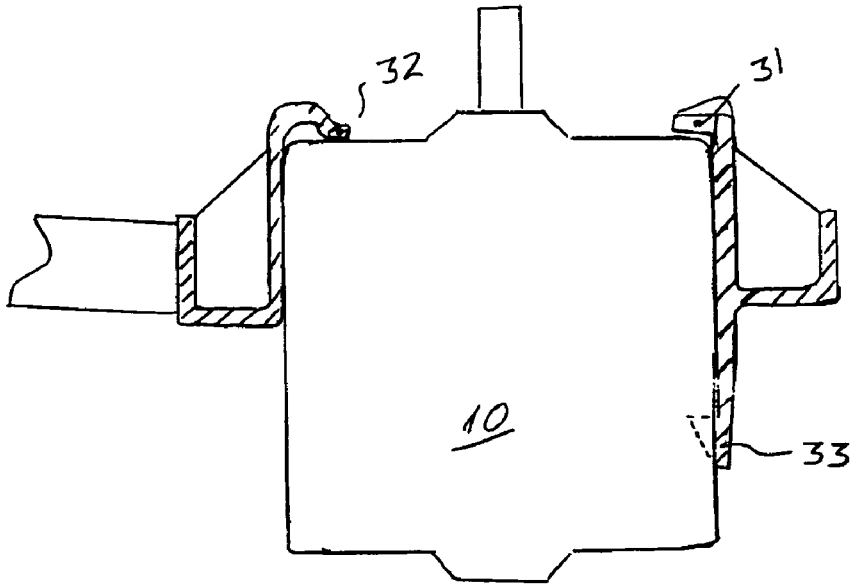
Figure 13:
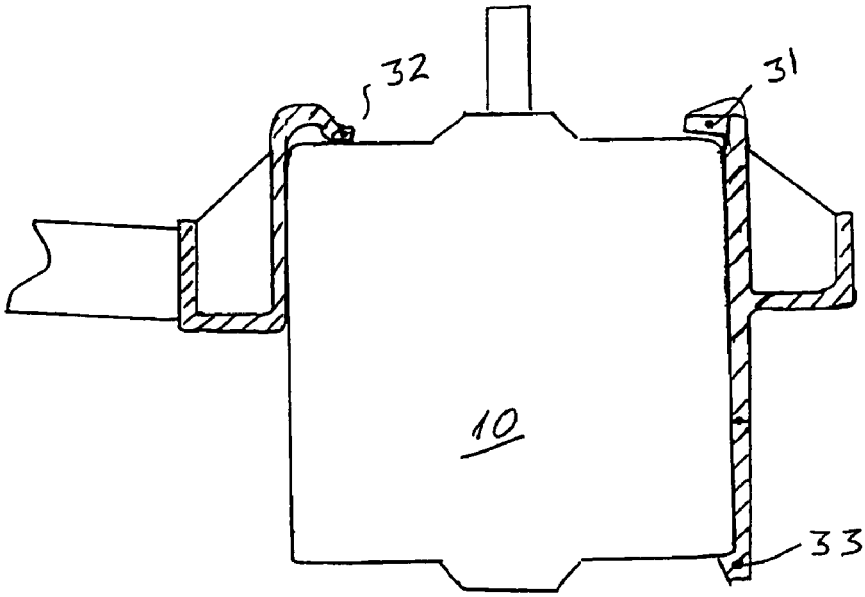
Figure 14:
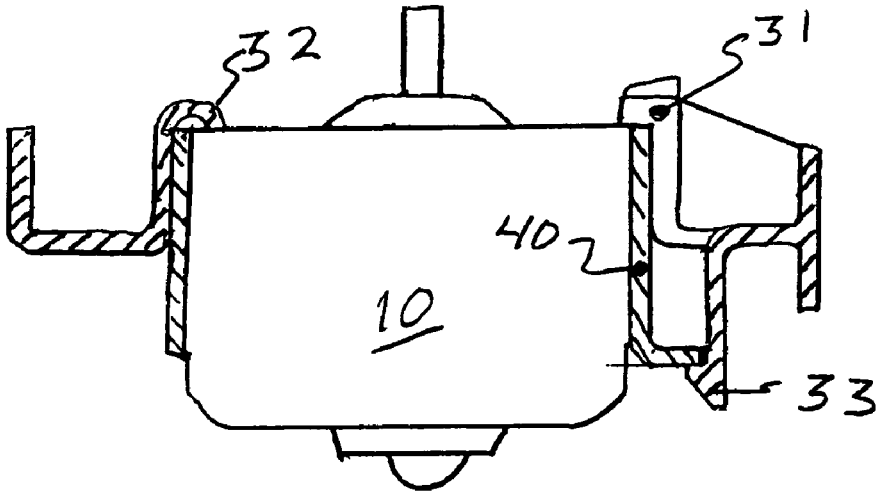

In FIG. 12, the latches 33 cooperate with holes in the motor case. In FIG. 13, latches cooperate with the edge of the case or end cover. In FIG. 14, latches cooperate with tabs formed in the flux ring. Such tabs can also be formed from the motor case or end covers, as illustrated in bayonet attachments already described.

Figure 15:
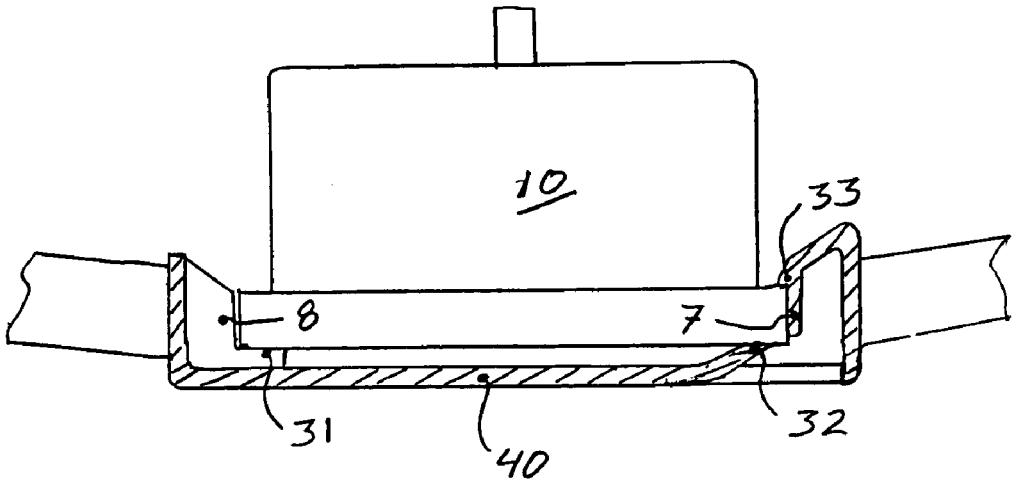
FIG. 15 is a partial cross-sectional, elevational view of a front-loaded motor and motor mount showing axial snap-fit features and integral heat and splash shield.

Another embodiment is shown in FIG. 15. The motor inserts from the front, allowing for the motor mounting structure to form a heat and splash shield 40, protecting the back plate of the motor from radiated heat and salt spray. The rigid cradling features 8 are ribs designed to contact the folded-over back plate of the motor. The flexible cradling features 7 are shown on the opposite side of the section. As with the embodiments of FIGS. 11-14, the locking recesses are replaced by axial retention elements 31, 32 and latches 33. In this case, the latches engage the folded-over back plate rather than radial tabs. Some axial retention elements 32 are elastic, so that they maintain a tight fit over the range of manufacturing variation. Others 31 are rigid. These are designed to have a looser fit than the elastic elements 32.

Figure 16:
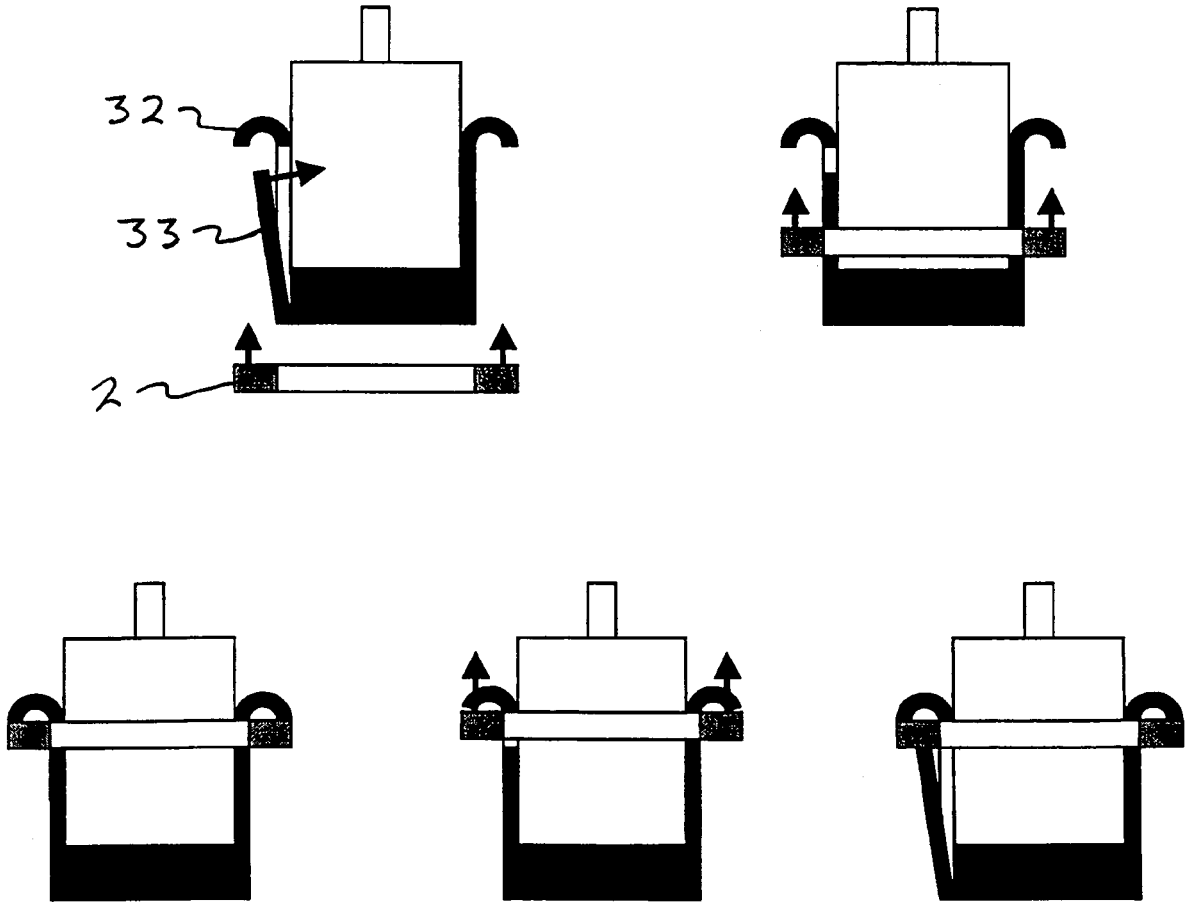
FIG. 16 is a partial cross-sectional view of a motor and motor mount showing some axial snap-fit features integrated with the motor instead of the motor mounting structure.

In FIG. 16, retention elements 32 and latches 33 are located on the motor. A single injection molded part comprises the end cover and/or brush holder as well as one or more retention elements and latches. In this case, the latches engage the motor mount 2. Some axial retention elements 32 can be elastic, so that they maintain a tight fit over the range of manufacturing variation.

Figure 17:
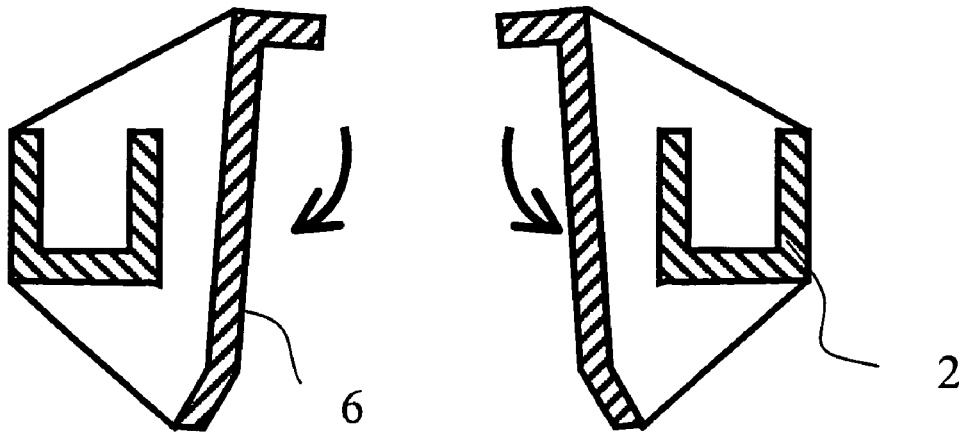
FIG. 17 is a partial cross-sectional, elevational view of a motor mount showing cradling features with draft.

In FIG. 17, cradling features 6 are arranged at an angle. This provides draft for easy injection molding. The motor mounting structure 2 provides a pliable profile connecting the cradling features. The angled surfaces also improve the process of assembly of motor within the motor mounting structure by providing initial positioning and controllable insertion forces.

Figure 18:
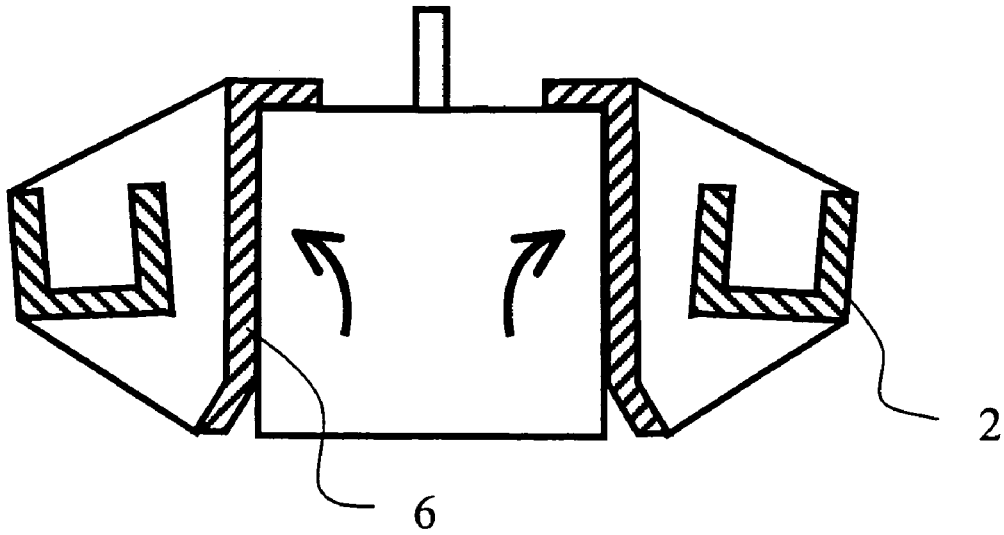
FIG. 18 is a partial cross-sectional, elevational view of a motor mount showing cradling features with draft and an installed motor.

FIG. 18 shows the motor mount from FIG. 17 with installed motor. The cradling features are rotated parallel to the external contour of the motor. The pliable profile connecting these features is twisted.

Other embodiments are within the following claims.

What is claimed is:

1. An automotive engine-cooling fan assembly comprising: a) a fan; b) a motor which drives the fan; and c) a housing comprising a motor mount to which the motor is mounted; wherein, the motor comprises multiple connector elements which are integral with the motor, and the motor mount comprises multiple recesses which are sized and shaped to receive and engage the connector elements of the motor by combined axial and rotational movement of the motor relative to the motor mount.

2. The assembly of claim 1 in which, the motor has an external casing; the connector elements of the motor comprise tabs extending generally radially beyond the motor casing; and the motor-mounting recesses are sized, shaped and positioned to receive the connector elements as a bayonet mount.

3. The assembly of claim 2 in which there are at least two tabs of different dimensions and the motor-mount recesses are sized and shaped to key the orientation of the motor as the motor is inserted into the motor mount.

4. The assembly of claim 2 in which the tabs are spaced unevenly around the circumference of the motor and the motor-mount recesses are positioned to key the orientation of the motor as inserted into the motor mount.

5. The assembly of claim 1 in which the motor mount further comprises radially elastic supports, which cradle the motor so as to exert a radial force on the motor, the motor being rotatable and axially moveable relative to the radially elastic supports.

6. The assembly of claim 5 in which the motor mount further comprises multiple rigid elements positioned to limit the radial travel of the motor and in which at least one of the rigid elements is integral with at least one of the radially elastic supports.

7. The assembly of claim 6 in which the rigid element is a rigid rib and at least part of the radially elastic support comprises surfaces, which extend in a generally circumferential direction from the rib and contact the surface of the motor with an interference fit.

8. The assembly of claim 1 or claim 5 in which the motor mount further comprises multiple rigid elements positioned to limit the radial travel of the motor.

9. The assembly of claim 1 in which the motor connector element is metal, and the motor mount is plastic.

10. The assembly of claim 1 in which the housing comprises members which extend generally radially inward and support the motor mount.

11. The assembly of claim 10 in which the housing further comprises a shroud structure which extends around the fan and supports the radial members.

12. The assembly of claim 11 in which the housing further comprises an air guide structure which guides the airflow between a heat exchanger and the fan.

13. The assembly of claim 12 in which the motor mount, the radial members, the shroud structure which extends around the fan, and the air guide structure are a single injection-molded plastic part.

14. The assembly of claim 11 in which the motor mount, the radial members and the shroud structure which extends around the fan are a single injection-molded plastic part.

15. The assembly of claim 10 in which the motor mount and the radial members are a single injection-molded plastic part.

16. The assembly of claim 1 in which the motor comprises a flux ring and the connector elements are integral with the flux ring.

17. The assembly of claim 1 in which the motor comprises an external casing and the connector elements are integral with the external casing.

18. The assembly of claim 1 in which the motor comprises an end cover, and the connector elements are integral with said end cover.

19. The assembly of claim 1 in which the motor mounting further comprises a resilient latch that prevents the motor from rotating after it is rotated into position.

20. The assembly of claim 1 in which the fan in operation rotates and exerts a torque on the motor, and the connector elements and the motor-mount recesses are shaped to permit insertion by rotation in the direction of said torque.

21. The assembly of claim 1 in which the motor-mount recesses are sized and shaped to permit the motor to slide into the motor mount as the motor is mounted from the front.

22. The assembly of claim 21 in which the motor mount further comprises a shield.

23. The assembly of claim 1 in which the motor-mount recesses are sized and shaped to permit the motor to be mounted from the rear.

24. The assembly of claim 23 in which the motor mount comprises an opening in its center and the front of the motor extends through the opening when in its final position.

25. A method of assembling the assembly of claim 1 by sliding the motor axially to engage the motor with the motor mount.

26. The method of claim 25 in which no fastening parts that are separate from the motor and housing are used.

27. The method of claim 25 in which the motor and the motor mount comprise matching threads, and the motor is screwed into the housing.

28. The method of claim 25 in which the motor first is moved axially and then is twisted to engage the motor mount.

* * * * *

UNITED STATES PATENT AND TRADEMARK OFFICE

CERTIFICATE OF CORRECTION

PATENT NO. : 7,318,394 B2
APPLICATION NO. : 10/877768
DATED : January 15, 2008
INVENTOR(S) : William M. Stevens et al.

It is certified that error appears in the above-identified patent and that said Letters Patent is hereby corrected as shown below:

Cover page, item (75) Inventors:

"Stephens Nicholls" should be -- Stephen Nicholls --.

"Hugo Hermann" should be -- Hugo Herrmann --.

"Britt Weigand" should be -- Britt Weingand --.

Cover page, please add the following "Related U.S. Application Data":

-- (63) Continuation of application No. 09/699,850, filed on Oct. 30, 2000. --.

-- (60) Provisional application No. 60/162,376, filed on Oct. 29, 1999. --.

Signed and Sealed this

Thirty-first Day of March, 2009

John Doll

JOHN DOLL
*Acting Director of the United States Patent and Trademark Office*